US007225938B2

(12) United States Patent
Frisch

(10) Patent No.: US 7,225,938 B2
(45) Date of Patent: Jun. 5, 2007

(54) DUAL CHAMBER NURSING BOTTLE

(76) Inventor: Ruchama Frisch, 360 Summit Ave., Cedarhurst, NY (US) 11516

( * ) Notice: Subject to any disclaimer, the term of this patent is extended or adjusted under 35 U.S.C. 154(b) by 0 days.

(21) Appl. No.: 10/735,313

(22) Filed: Dec. 11, 2003

(65) Prior Publication Data

US 2005/0127020 A1 Jun. 16, 2005

(51) Int. Cl.
*A61J 9/00* (2006.01)
*A61J 11/00* (2006.01)

(52) U.S. Cl. ..... 215/11.4; 215/6; 215/11.1; 215/386; 220/714

(58) Field of Classification Search ..... 215/11.1, 215/11.4, 11.5; 220/714
See application file for complete search history.

(56) References Cited

U.S. PATENT DOCUMENTS 154,562 A * 9/1874 Perkins ..... 215/11.2
2,594,114 A * 4/1952 Baracate ..... 215/11.1
2,622,420 A * 12/1952 Rice ..... 215/309
2,745,568 A * 5/1956 Newton ..... 215/11.4
2,786,769 A * 3/1957 Greenspan ..... 426/117
2,836,321 A * 5/1958 Soltesz et al. ..... 215/11.1
3,211,315 A * 10/1965 Griesinger ..... 215/11.1
3,519,157 A * 7/1970 Meierhoefer ..... 215/11.6
4,121,731 A * 10/1978 Okerstrum ..... 220/715
4,856,995 A * 8/1989 Wagner ..... 433/215
5,169,016 A * 12/1992 Hinz, Jr. ..... 222/506
5,275,298 A * 1/1994 Holley et al. ..... 215/11.4
5,295,597 A * 3/1994 Green ..... 215/11.4
5,353,964 A * 10/1994 Liu et al. ..... 222/134
5,433,328 A * 7/1995 Baron et al. ..... 215/11.4
5,667,084 A * 9/1997 Duggal et al. ..... 215/11.4
5,711,452 A * 1/1998 Chaffin ..... 220/715
5,938,053 A * 8/1999 Verbovszky et al. ..... 215/6
6,253,936 B1 * 7/2001 Kong ..... 215/11.3
6,854,595 B2 * 2/2005 Kiser ..... 206/222
2004/0188372 A1 * 9/2004 Ruth et al. ..... 215/11.4

* cited by examiner

*Primary Examiner*—Sue A. Weaver
(74) *Attorney, Agent, or Firm*—Bernard Malina; Malina & Associates PLLC

(57) ABSTRACT

A dual chamber nursing bottle includes a first chamber, a second chamber, a closure which defines the second chamber, and a valve member which communicates between the first and second chambers to control the flow of fluid from the first chamber to the second chamber and then feed an infant using the nursing nipple which is mounted on the first chamber.

15 Claims, 5 Drawing Sheets

DUAL CHAMBER NURSING BOTTLE

FIELD OF THE INVENTION

The present invention relates generally to the field of equipment for the feeding of infants and more particularly, to a dual chamber nursing bottle.

BACKGROUND OF THE INVENTION

The prior art related to equipment for feeding infants includes a range of devices which usually include a flexible nursing nipple which is mounted in the removable cap of a bottle. The cap and the bottle typically form a threaded closure.

One of the disadvantages of the apparatus according to the prior art is related to the use of the apparatus in the feeding of infants with regard to the use of breast milk and/or baby formula. When bottle feeding an infant using breast milk or formula, the Infant oftentimes does not drink all the milk. Because both breast milk and infant formula have significant value, it would be desirable to be able to store the partially used bottle. However, the storage of a partially used bottle is objectionable because bacteria present in the infant's saliva may ooze through the nipple into the milk remaining in the bottle. This increases the rate of spoilage of the remaining milk.

This problem of spoilage is especially troublesome when feeding infants who take only small amounts of milk at each feeding thereby extending the periods during which the conventional partially filled nursing bottle must be stored.

OBJECTS AND SUMMARY OF THE INVENTION

It is an object of the present invention to provide a dual chamber nursing bottle which enables the storage of milk in a storage chamber and the dispensing of the milk from the storage chamber into a feeding chamber.

Another object of the present invention is to provide a dual-chamber nursing bottle which can be conveniently operated with one hand.

Another object of the present invention is to provide a dual-chamber nursing bottle which can be easily cleaned.

Yet another object of the present invention is to provide a dual-chamber nursing bottle which includes a relatively small number of relatively simple component parts which can be manufactured economically in volume, resulting in a relatively low overall cost.

Additional objects and advantages of the present invention will appear more clearly hereinafter.

In accordance with the present invention, there is provided a dual-chamber nursing bottle which includes a first, relatively larger, storage chamber and a second, relatively smaller feeding chamber. A soft rubber nursing nipple is connected to the second chamber for feeding an infant. The first and second chambers are connected by a threaded closure. A transfer valve is mounted on the threaded closure to allow the transfer of selected quantities of milk from the first chamber into the second chamber.

In the primary embodiment of the invention, the transfer valve is formed as a unitary valve member which is made of a flexible material such as a food grade rubber or plastic material. The valve member includes an activation portion which projects through an aperture which is formed in the threaded closure and which connects the first and the second chamber. The valve member includes an aperture which leads to a slit which has a normally closed portion. The slit is oriented generally parallel to a longitudinal axis of the valve member. Manual pressure on the activation portion in a direction which compresses the valve member forces the slit portion to open and allows milk to flow from the first chamber to the second chamber.

BRIEF DESCRIPTION OF THE DRAWINGS

Other important objects of the present invention will be apparent from the following detailed description of the invention taken in connection with the accompanying drawings in which.

DETAILED DESCRIPTION OF THE INVENTION

Figure 1:
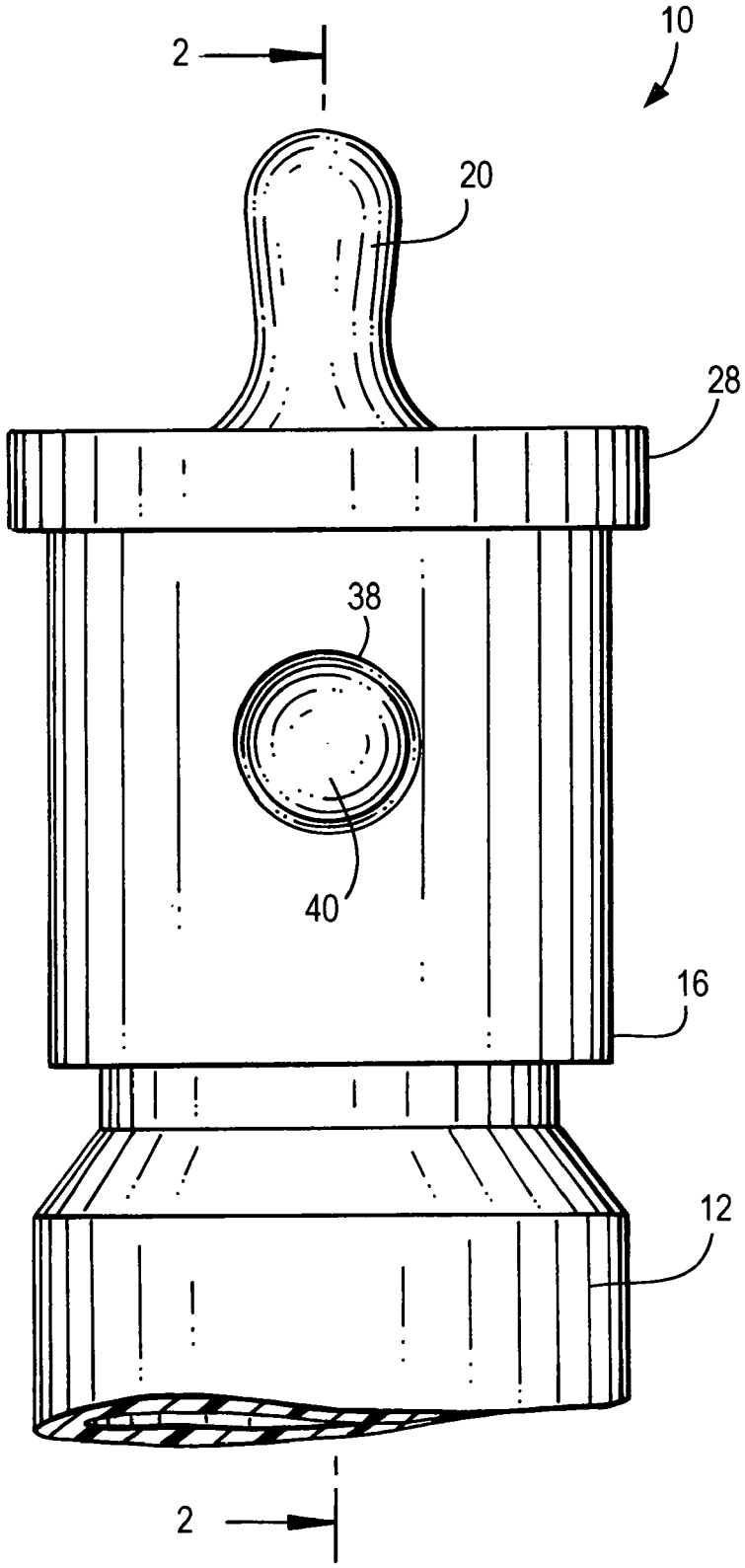
FIG. 1 is a fragmentary elevation view of a dual chamber nursing bottle made according to the present invention.
Figure 3:
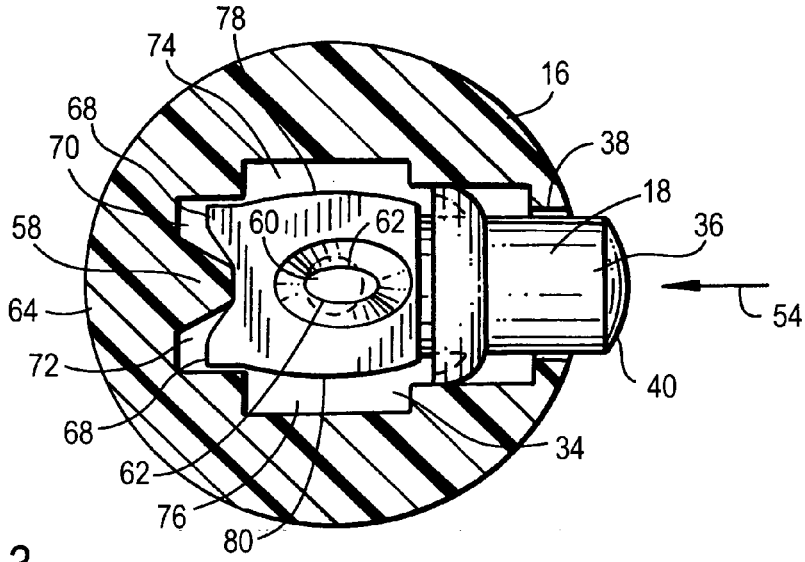
FIG. 3 is a cross-sectional view taken along the line 3—3 of FIG. 2 showing the valve member in the open position.

With reference to the drawings, there is shown in FIG. 1 a dual chamber nursing bottle 10, made in accordance with the present invention which comprises a first chamber 12, a second chamber 14, a closure 16 which defines the second chamber 14, a valve member 18, and a nursing nipple 20.

Figure 2:
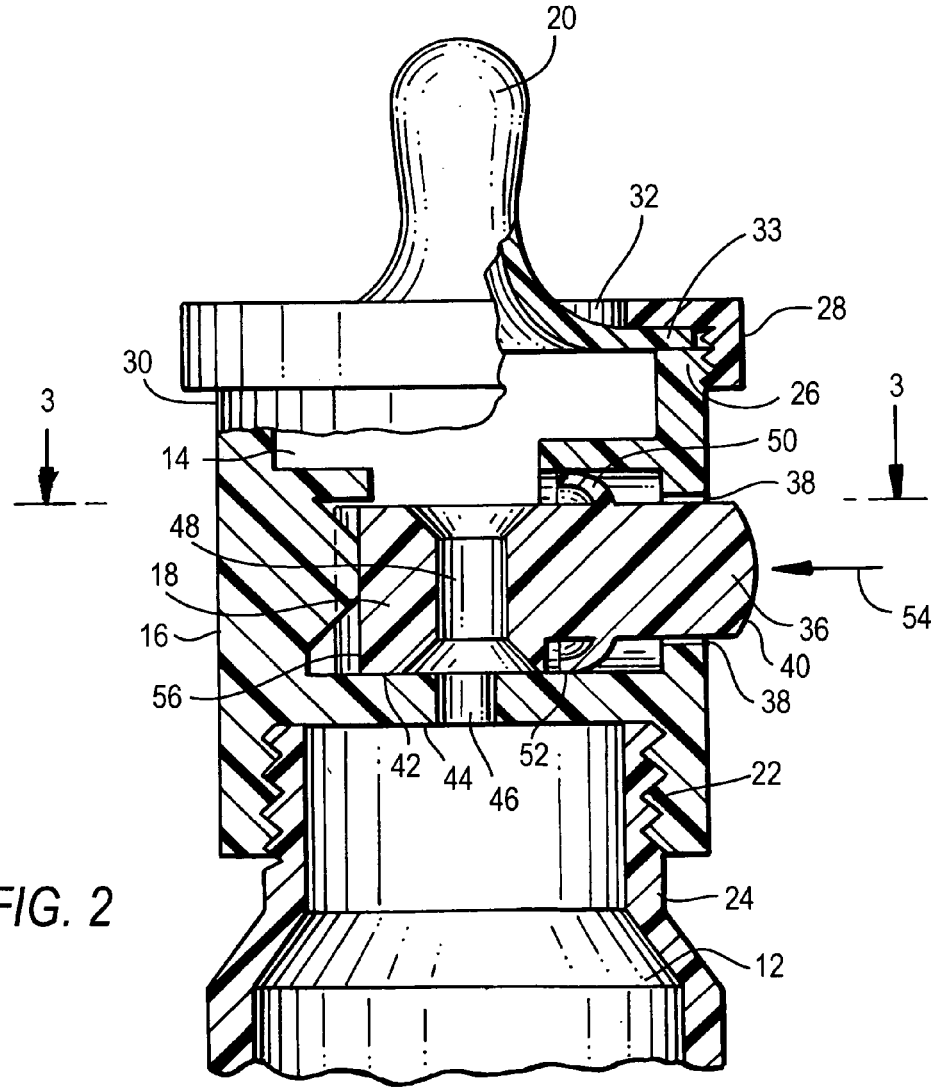
FIG. 2 is a cross-sectional view taken along the line 2—2 of FIG. 1.
Figure 4:
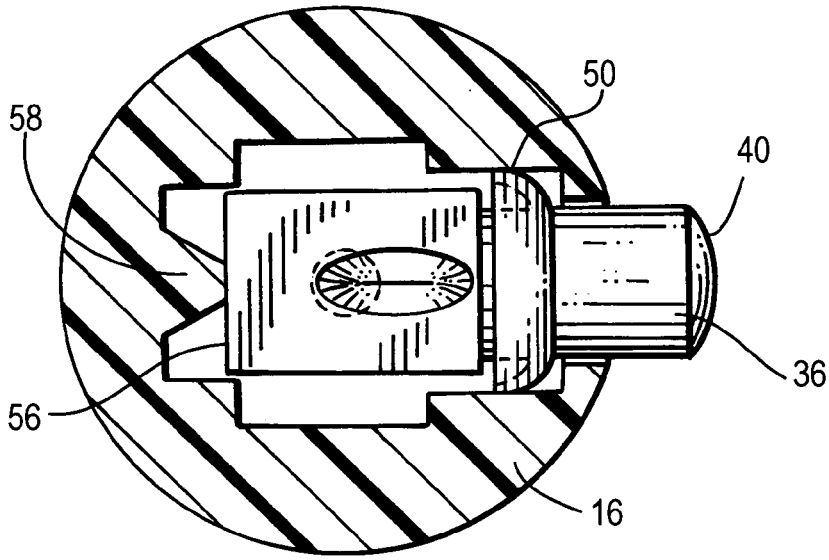
FIG. 4 is a cross-sectional view taken along the line 3—3 of FIG. 2 similar to FIG. 3 showing the valve in the closed position.
Figure 5:
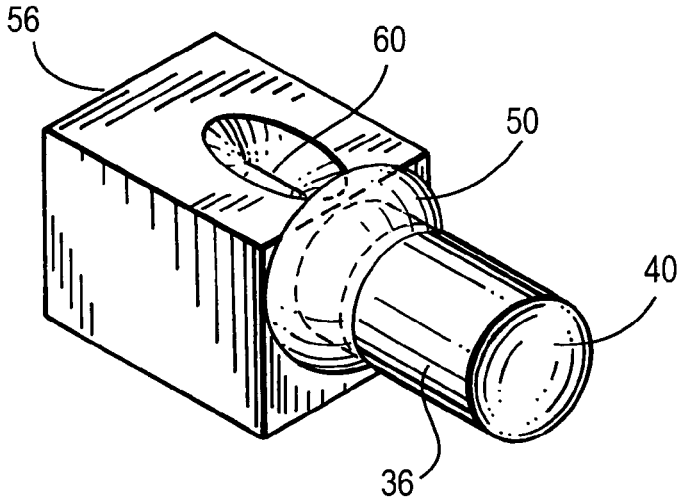
FIG. 5 is a perspective view of the valve member with the valve member shown removed from the apparatus of FIG. 1.

As is best shown in FIG. 2, the first or relatively larger chamber 12 is generally cylindrical and has the overall configuration of a conventional nursing bottle. The lower end of the closure 16 includes a first threaded portion 22, which is threaded onto the upper end 24 of the first chamber 12.

In addition to the first threaded portion 22 which engages the first chamber 12, the closure 16 includes a second threaded portion 26 which engages the cap 28.

The cap 28 is threaded onto the upper end 30 of the closure 16 as is shown in FIG. 2. A convention nursing nipple 20 projects through an aperture 32 in the cap 28 and is retained by the cap 28 which bears on the flange 33 which is formed on the nipple 20.

The valve member 18 which forms an important feature of the present invention is mounted in a cavity 34 which is formed in the closure 16. The valve member 18 is a unitary member which is made of a flexible material such as food or medical grade rubber or plastic. The valve member 18 includes a projecting portion 36 which projects through an aperture 38 formed in the closure 16 in a generally radial direction relative to the closure 16. The outer end 40 of the projecting portion 36 is convexly rounded and projects beyond the curved surface of the closure 16.

The lower portion 42 of the valve member 18 rests on the plate portion 44 of the closure 16. The plate portion 44 of the closure 16 includes an aperture 46. The aperture 46 is generally in line with a normally closed aperture 48 formed in the valve member 18.

The valve member 18 includes a relatively thin lip portion 50 which is proportioned to bear against the surface 52 of the aperture 38 thus forming a seal.

The aperture 48 formed in the valve member 18 is normally closed. Pressure exerted by a user in the direction shown by the arrow 54 in FIG. 2 causes the end 56 of the valve member 18 to bear against the projecting portion 58 of the closure 16 and forces a slit 60 formed by wall portion 62 defining the aperture 48 to open. As is shown in FIG. 2, the portion 64 of the closure 16 includes the projecting portion 58 against which the end 68 of the valve member 18 bears.

The cavity area 70, 72 adjacent to the projecting portion 58 provides room for the end 68 of the valve member 18 to flex into as pressure is applied to the projecting portion 36. The projecting portion 58 of the closure 16 is generally in line with the slit 60 and forces the slit 60 to open when pressure is applied to the projecting portion 36. The closure 16 includes opposition cavity portions 74, 76 which accommodate the flexing and bulging of the sides 78, 80 of the valve member 18 when pressure is applied to the valve member 18.

When pressure is applied to the projecting portion 36 of the valve member 16, the slit 60 is forced open and milk or other fluid in the first chamber 12 can flow into the second chamber 14. Releasing the pressure on the valve member 18 allows the elastic properties of the valve member 18 to close the slit 60 thereby sealing the first chamber 12.

The valve member 18 thus enables a user to transfer a desired quantity of fluid such as milk from the first chamber 12 to the second chamber 14 and then feed an infant using the nursing nipple 20. When the feeding has been completed, the unused milk is retained in the first chamber 12, which remains sealed through the action of the valve member 18.

The valve member 18 thus enables a user to transfer a desired quantity of fluid such as milk, from the first chamber 12 to the second chamber 14 and then feed an infant using the nursing nipple 20. When the feeding has been completed, the unused milk is retained in the first chamber 12 which remains sealed through the action of the valve member 18. The nursing bottle 10 according to the invention can be stored under refrigeration as desired with the fluid which is in the first chamber 12 remaining in a clean and uncontaminated condition.

Figure 7:
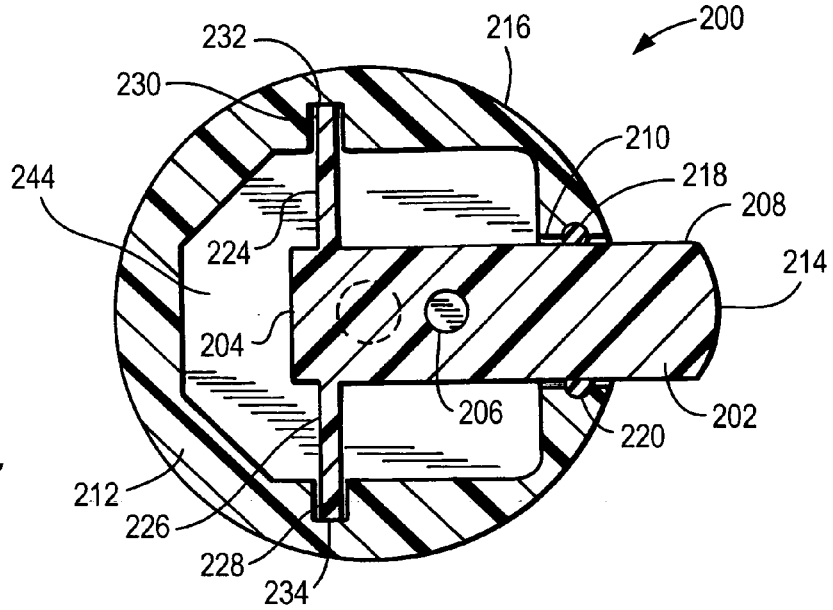
FIG. 7 is a cross-sectional view taken along the line 7—7 of FIG. 6 showing the valve member in the closed position.
Figure 6:
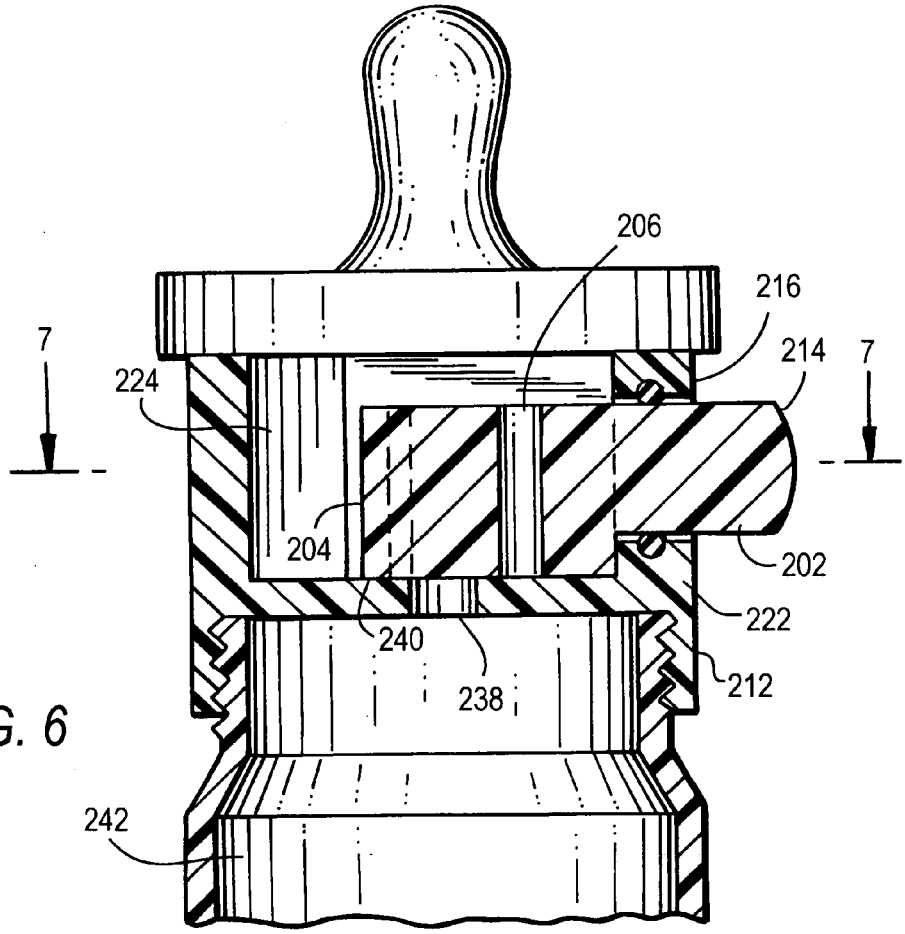
FIG. 6 is a cross-section view similar to FIG. 2 showing an alternate embodiment of the invention.
Figure 8:
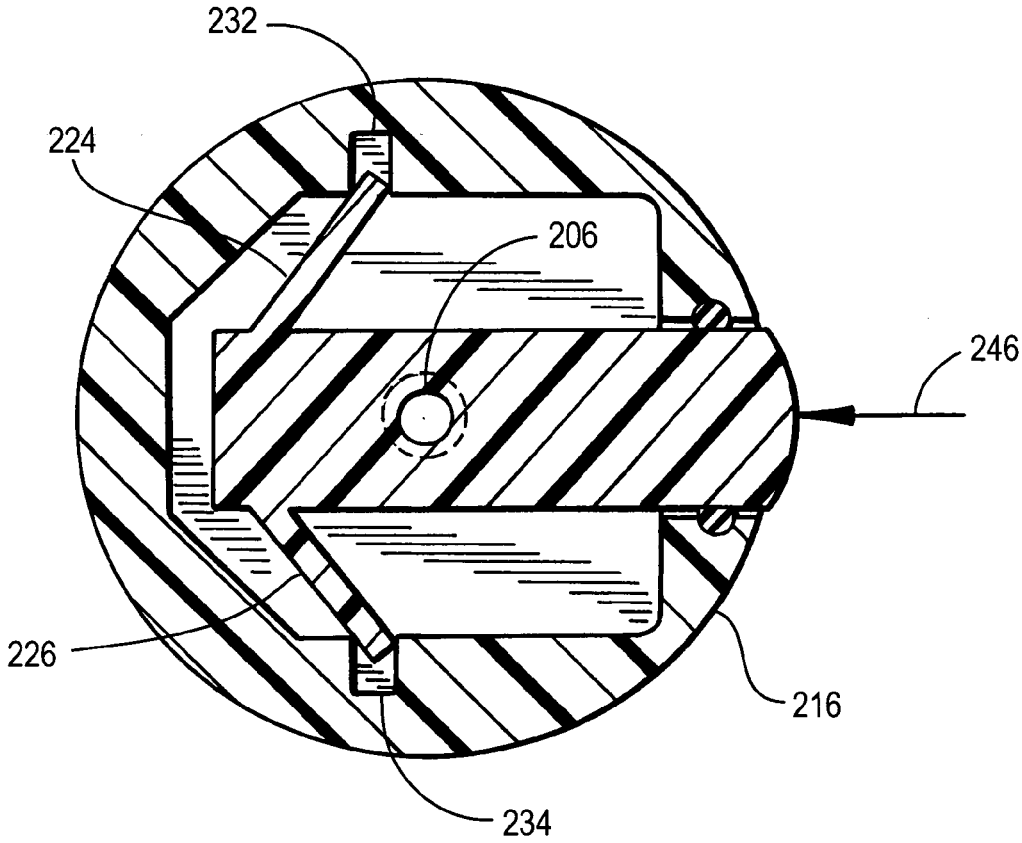
FIG. 8 is a cross-sectional view taken along the line 7—7 of FIG. 6 similar to FIG. 7 showing the valve member in the open position.

FIGS. 6–8 show another embodiment of the invention 200 in which the valve member 18 is replaced by a sliding valve member 202. As is shown in FIG. 6, the sliding valve member 202 is an integrally formed member which may be made of a flexible medical or food grade rubber or plastic material. The valve member 202 includes a body portion 204 which has a bore 206 and a projecting portion 208 which projects through an aperture 210 which is formed in the closure 212. The end 214 of the projecting portion 208 is convexly rounded and projects past the outer surface 216 of the closure 212. An O-ring seal 218 is lodged in a groove 220 which is formed in an intermediate portion 222 of the closure 212. The O-ring seal 218 prevents leakage of fluid from the closure 212.

The valve member 202 also includes a pair of oppositely directed flange portions 224, 226. The outer ends 228, 230 of which are lodged in apertures 232, 234, which are formed in the closure 212. The flange portions 224, 226 act as springs and maintain the normally closed position of the valve member 202. As shown in FIGS. 6 and 7 in which the bore 206 is not in alignment with the aperture 238 in the closure 212 and the surface 240 of the valve member 202 blocks the flow of fluid from the first chamber 242 into the second chamber 244.

When the projecting portion 208 is pressed inwardly in the direction shown by the arrow 246 in FIG. 8, the flange portions 224, 226 flex and the bore 206 comes into alignment with the aperture 238 in the closure 212 allowing fluid to flow from the first chamber 242 into the second chamber 244.

The operation of nursing bottle 200 of FIGS. 6–8 is thus the same as the operation of the nursing bottle 10 as previously described.

The foregoing specific embodiments of the present invention as set forth in the specification herein are for illustrative purposes only. Various deviations and modifications may be made within the spirit and scope of this invention without departing from the main theme thereof.

What is claimed is:

1. A dual chamber nursing bottle comprising:

a first chamber;

a second chamber;

attachment means connecting said first chamber and said second chamber; elastomeric valve means mounted on said attachment means with said valve means communicating between said first and said second chambers, said valve means having a first position normally closed for preventing a fluid in said second chamber from entering said first chamber and a second position requiring human activation for opening to allow flow of said fluid from said second to said first chamber, said valve means comprising a radially oriented projecting portion disposed outwardly through a single aperture in a wall of said attachment means, said human activation for opening flow being continuous manual pressure applied in a radial direction parallel against an outermost end of the radially oriented projecting portion; and a nursing nipple mounted on said first chamber.

2. The dual chamber nursing bottle as claimed in claim 1 wherein said attachment means comprises threaded closure means.

3. The dual chamber nursing bottle as claimed in claim 1 wherein said valve means comprises a flexible member.

4. The dual chamber nursing bottle as claimed in claim 1 wherein said projecting portion is formed on said attachment means.

5. The dual chamber nursing bottle as claimed in claim 1 further comprising a sealing lip formed on said valve means and disposed bearing against said attachment means thereby forming a seal between said attachment means and said valve means.

6. The dual chamber nursing bottle as claimed in claim 1 wherein said valve means comprises a pair of flange portions.

7. The dual chamber nursing bottle as claimed in claim 6 wherein said flange portions comprise resilient flange members with said flange members each comprising an outer portion and a pair of recess portions formed in the aperture with said outer portion of said flange members.

8. The dual chamber nursing bottle as claimed in claim 1 wherein said valve means comprises an aperture portion.

9. A dual chamber nursing bottle comprising:

a first chamber;

a second chamber;

attachment means connecting said first chamber and said second chamber;

valve means mounted on said attachment means with said valve means communicating between said first and said second chambers, said valve means having a first position normally closed for preventing a fluid in said second chamber from entering said first chamber and a second position requiring human activation for opening to allow flow of said fluid from said second to said first chamber, said valve means comprising a radially oriented projecting portion disposed outwardly through a single aperture in a wall of said attachment means, said valve means further comprising a closed flexible slit openable under pressure applied against said projecting portion; and a nursing nipple mounted on said first chamber.

10. A dual chamber nursing bottle as claimed in claim 9 further comprising a cavity area into which bulging areas of said projecting portion are accommodated when said pressure is applied.

11. The dual chamber nursing bottle as claimed in claim 9 wherein said attachment means comprises threaded closure means.

12. The dual chamber nursing bottle as claimed in claim 9 wherein said valve means comprises a flexible member.

13. The dual chamber nursing bottle as claimed in claim 9 wherein said projecting portion is formed on said attachment means.

14. The dual chamber nursing bottle as claimed in claim 9 further comprising a sealing lip formed on said valve means and disposed bearing against said attachment means thereby forming a seal between said attachment means and said valve means.

15. The dual chamber nursing bottle as claimed in claim 9 wherein said valve means comprises an aperture portion.

* * * * *